US009835969B2

(12) United States Patent
Takahashi et al.

(10) Patent No.: US 9,835,969 B2
(45) Date of Patent: Dec. 5, 2017

(54) IMAGE FORMING APPARATUS HAVING A PLURALITY OF SELECTIVELY CHARGED PHOTOSENSITIVE BODIES AND CONTROLLING METHOD FOR SAME

(71) Applicant: Brother Kogyo Kabushiki Kaisha, Nagoya (JP)

(72) Inventors: Masamitsu Takahashi, Nagoya (JP); Masahito Hamaya, Nagoya (JP); Hiroki Katoh, Tokai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 15/228,309

(22) Filed: Aug. 4, 2016

(65) Prior Publication Data

US 2017/0038700 A1 Feb. 9, 2017

(30) Foreign Application Priority Data

Aug. 5, 2015 (JP) ..... 2015-154763

(51) Int. Cl.
*G03G 15/02* (2006.01)

(52) U.S. Cl.
CPC ..... *G03G 15/0266* (2013.01)

(58) Field of Classification Search
CPC ..... G03G 15/0283; G03G 2215/00654
See application file for complete search history.

(56) References Cited

U.S. PATENT DOCUMENTS

2004/0062064 A1* 4/2004 Pelly ..... H02M 1/126 363/100
2008/0226317 A1 9/2008 Nakazawa
2011/0293301 A1* 12/2011 Hayakawa ..... G03G 15/1605 399/44
2012/0027436 A1* 2/2012 Maruyama ..... G03G 15/0291 399/31

(Continued)

FOREIGN PATENT DOCUMENTS

JP 08278674 A * 10/1996
JP 2007-199371 A 8/2007

(Continued)

OTHER PUBLICATIONS

JP_08278674_A_T Machine Translation Haneda Japan 1996.*

*Primary Examiner* — Victor Verbitsky
(74) *Attorney, Agent, or Firm* — Burr & Brown, PLLC

(57) ABSTRACT

An image forming apparatus is provided with a first photosensitive body, a second photosensitive body, a first charger configured to charge the first photosensitive body, a second charger configured to charge the second photosensitive body, a voltage outputting circuit, a voltage dropping circuit, and a controller. The controller is configured to selectively execute a first charging control to apply a first voltage to the first charger and the second charger, the first voltage being an output of the voltage outputting circuit, and a second charging control to apply the first voltage to the first charger a second voltage to the second charger, the second voltage being less than the first voltage, the first voltage being an input of the voltage dropping circuit and the second voltage being an output of the voltage dropping circuit.

12 Claims, 11 Drawing Sheets

(56) References Cited

U.S. PATENT DOCUMENTS

| | | | |
|---|---|---|---|
| 2012/0027437 | A1 | 2/2012 | Maruyama et al. |
| 2012/0051772 | A1 | 3/2012 | Inukai |
| 2012/0057888 | A1 | 3/2012 | Inukai |

FOREIGN PATENT DOCUMENTS

| | | | |
|---|---|---|---|
| JP | 2008-224994 | A | 9/2008 |
| JP | 2012-032532 | A | 2/2012 |
| JP | 2012-048032 | A | 3/2012 |
| JP | 2012-053350 | A | 3/2012 |
| JP | 2012-058331 | A | 3/2012 |
| JP | 2013-134429 | A | 7/2013 |

* cited by examiner

AT COLOR PRINTING (K, Y, M, C: CONTACT POSITIONS)

AT MONOCHROME PRINTING
(K: CONTACT POSITION; Y, M, C: SPACED POSITIONS)

AT THIRD MODE (K, Y, M, C: SPACED POSITIONS)

AT COLOR PRINTING

AT MONOCHROME PRINTING

AT THIRD MODE

IMAGE FORMING APPARATUS HAVING A PLURALITY OF SELECTIVELY CHARGED PHOTOSENSITIVE BODIES AND CONTROLLING METHOD FOR SAME

This application claims priority under 35 U.S.C. §119 from Japanese Patent Application No. 2015-154763 filed on Aug. 5, 2015. The entire subject matter of the application is incorporated herein by reference.

BACKGROUND

Technical Field

The present disclosures relate to an image forming apparatus, and a controlling method of an image forming apparatus.

Related Art

There has been known an image forming apparatus which is provided with multiple photosensitive bodies corresponding to multiple colors (e.g., black, yellow, magenta and cyan) of developing agents, and multiple chargers configured to charge the multiple photosensitive bodies, respectively. In such an image forming apparatus, the multiple chargers are electrically connected in parallel, and a single voltage outputting circuit is provided to apply a common voltage to the multiple chargers. According to such a configuration, the number of parts can be reduced and the image forming apparatus can be downsized.

SUMMARY

When monochrome printing is executed with use of the image forming apparatus having multiple photosensitive bodies, only one of the multiple photosensitive bodies is used to form a monochrome image. According to the above-described conventional technique, even when only one of the photosensitive bodies is used, the common voltage applied to all of the multiple chargers, some of which may not be used for printing.

According to aspect of the disclosures, there is provided an image forming apparatus, which is provided with a first photosensitive body, a second photosensitive body, a first charger configured to charge the first photosensitive body, a second charger configured to charge the second photosensitive body, a voltage outputting circuit, a voltage dropping circuit, and a controller. The controller is configured to selectively execute a first charging control to apply a first voltage, which is an output of the voltage outputting circuit, to the first charger and the second charger, which are connected in parallel, and a second charging control to apply the first voltage to the first charger and a second voltage to the second charger, the second voltage being less than the first voltage, the first voltage being an input of the voltage dropping circuit and the second voltage being an output of the voltage dropping circuit.

According to aspects of the disclosure, there is also provided a controlling method of an image forming apparatus having a first photosensitive body, a second photosensitive body, a first charger configured to charge the first photosensitive body, a second charger configured to charge the second photosensitive body, a voltage outputting circuit and a voltage dropping circuit. The method includes a first charging step to apply a first voltage to the first charger and the second charger. The second voltage is less than the first voltage and is an output of the voltage dropping circuit while the first voltage is an input of the voltage dropping circuit.

It is noted that the technique disclosed in the present specification can be realized in various ways. For example, the technique may be realizes in forms of an image forming apparatus, a control method of an image forming apparatus, computer programs prepared to realize such a method or functions of such an apparatus, a non-transitory computer-readable medium storing such computer programs (i.e., computer-executable instructions).

BRIEF DESCRIPTION OF THE ACCOMPANYING DRAWINGS

FIG. 1 schematically shows an entire configuration of a printer according to an embodiment of the disclosures.

DETAILED DESCRIPTION OF THE EMBODIMENT AND MODIFICATIONS

Figure 1:
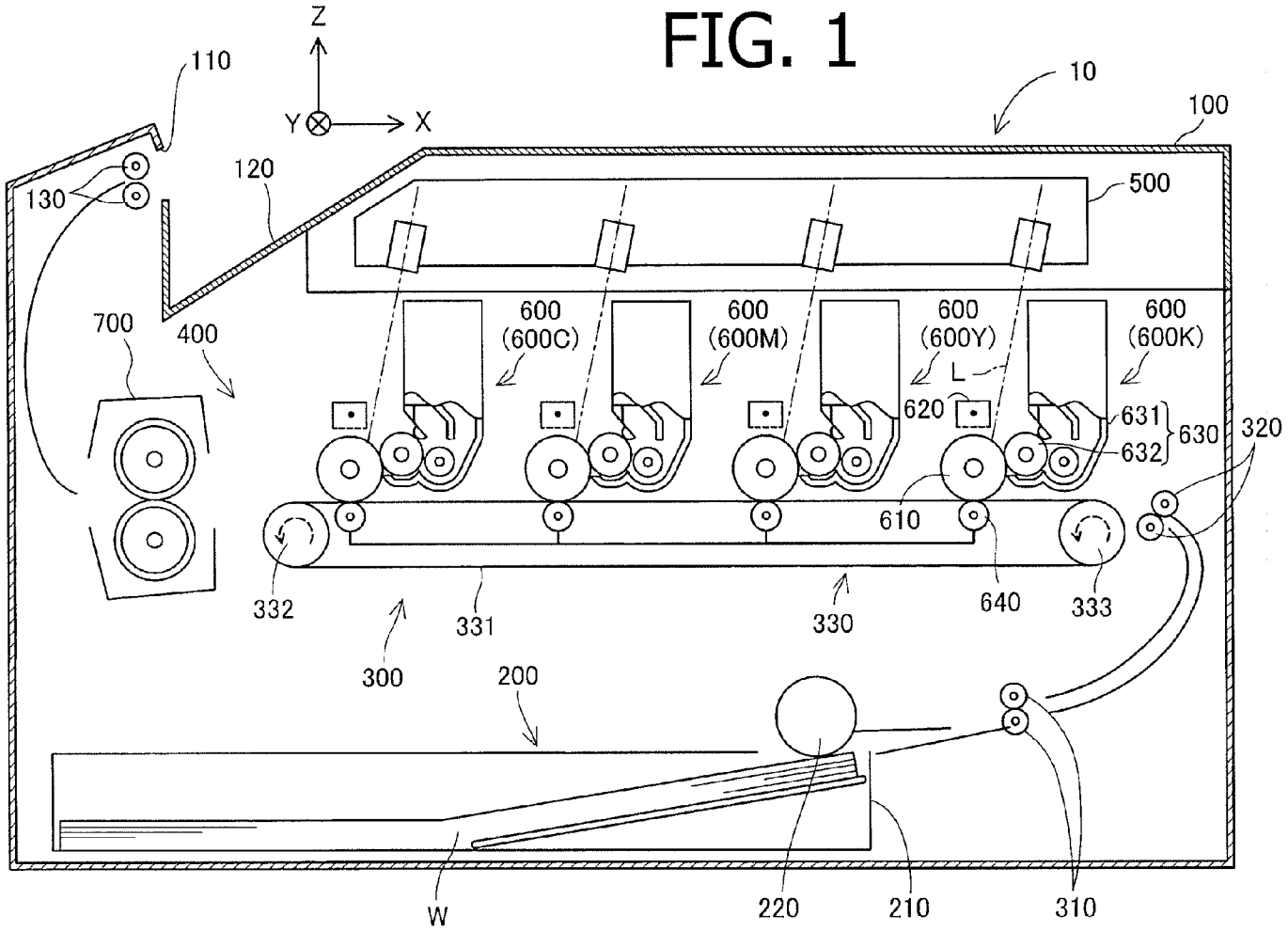

Hereinafter, a printer 10 according to an embodiment of the disclosures, and its modifications will be described with reference to the accompanying drawings. It is noted that mutually orthogonal three axes (i.e., X, Y and Z axes) are indicated in FIG. 1 to identify directions in the description below. In the following description, for the sake of convenience, directions are referred to as indicated below. That is, positive and negative directions along the Z axis will be referred to as upper and lower directions, respectively, positive and negative directions along the X axis will be referred to as front and rear directions, respectively, and positive and negative directions along the Y axis will be referred to as right and left directions, respectively. The above definition will apply in the remaining drawings as well.

The printer 10 is an electrophotographic printer configured to form an image on a sheet W with four colors of toner (or developing agents) of black (hereinafter, abbreviated as K), yellow (hereinafter, abbreviated as Y), magenta (hereinafter, abbreviated as M) and cyan (hereinafter, abbreviated as C). It is noted that the printer 10 is an example of an image forming apparatus set forth in the claims.

In the following description, when components of the printer 10 are provided for each of the four colors and respective components are to be distinguished by color, the above abbreviation letters K, Y, M and C are suffixed to reference numbers/letters of respective components, while when the components are described without being distinguished by color, such a suffix will be omitted. Further, when components provided for respective colors are described, one of the components for a particular color will be described representatively, and description on the remaining components will be omitted for brevity.

As shown in FIG. 1, the printer 10 has a casing 100 which accommodates a sheet supplier 200, a sheet conveyer 300, and an image forming unit 400. On an upper surface of the casing 100, a discharge port 110 and a discharge tray 120 are formed, and a discharge roller pair 130 is arranged inside the casing 100 and in the vicinity of the discharge port 110.

The sheet supplier 200 has a tray 210 and a pickup roller 220. The tray 210 is a container configured to accommodates the sheets W. The pickup roller 220 is configured to pick up the sheets W accommodated in the tray 21 one by one, and feed the picked up sheet toward the sheet conveyer 300.

The sheet conveyer 300 has a conveying roller pair 310, a registration roller pair 320 and a belt unit 330. The conveying roller pair 310 is configured to covey the sheet W supplied form the sheet supplier 200 toward the registration roller pair 320. The registration roller pair 320 is configured to correct a skew to the sheet W conveyed from the conveying roller pair 310, and further convey the sheet W toward the belt unit 330. The belt unit 330 has an endless belt 331, a driving roller 332 and a driven roller 333. The driving roller 332 and the driven roller 333 are rotatable about respective rotation axes, which are arranged in parallel to each other and extend in the Y axis direction. The endless belt 331 is stretched between the driving roller 332 and the driven roller 333, and rotates in association with rotation of the driving roller 332. The sheet W conveyed by the registration roller pair 320 is placed on a sheet conveying surface, which is a part of an outer circumferential surface of the endless belt 331 and facing the multiple photosensitive bodies 610, and conveyed toward a fixing unit 700 as the belt 331 rotates. It is noted that transferring rollers 640, which constitute process units 600, respectively, are provided inside a course of the endless belt 331.

The image forming unit 400 has an exposing unit 500, four process units 600 (i.e., 600K, 600Y, 600M and 600C) corresponding to the four colors (i.e., K, Y, M and C colors), and the fixing unit 700. The exposing unit 500 is configured to emit laser light L (i.e., four laser beams) to photosensitive bodies 610 which are provided to the process units 600, respectively.

The four process units 600 are arranged along a conveying direction of the sheet W which is conveyed by the endless belt 331 (i.e., a front-rear direction). In the following description, the process unit 600K for black color will be described. As mentioned above, the process unit 600K is described as a representative one of the four process units 600 (i.e., 600K, 600Y, 600M and 600C), and the other process units 600 have the same configuration as the process unit 600K.

Each process unit 600 includes the photosensitive body 610, the charger 620, a developing unit 630 and the transferring roller 640. The photosensitive body 610 is a cylindrical drum-shaped member rotatable about an axis which extends in the Y axis direction.

Figure 2:
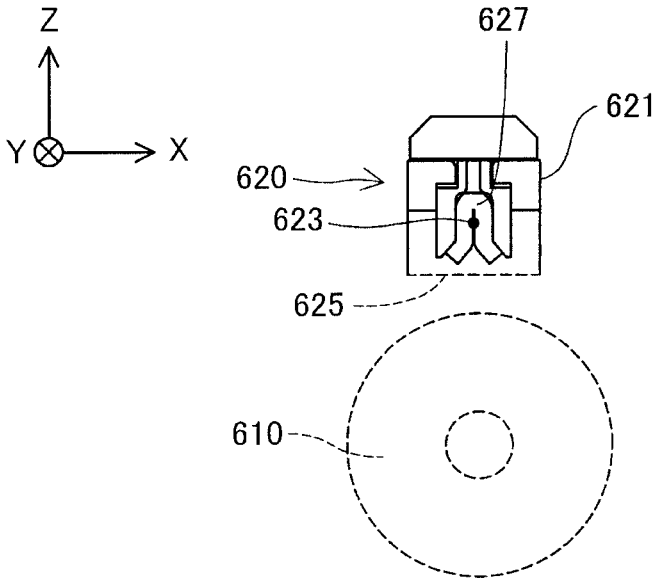
FIG. 2 shows a configuration of a charger according to the embodiment of the disclosures.
Figure 3:
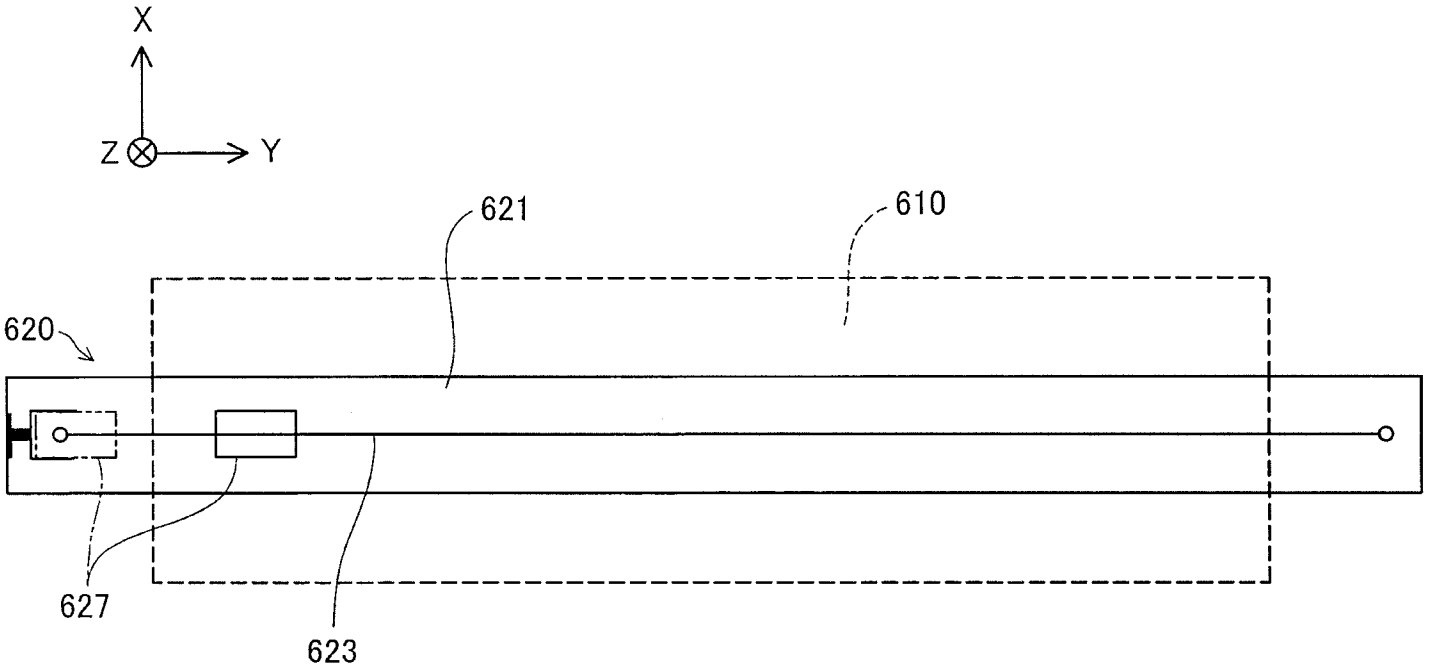
FIG. 3 shows a configuration of a charger according to the embodiment of the disclosures.

The charger 620 is a scorotron type corona charger, and includes a shield case 621, a wire electrode 623 and a grid electrode 625 as shown in FIGS. 2 and 3. The shield case 621 has a U-shaped cross section extending in a direction of the rotation axis of the photosensitive body 610, and opens facing the photosensitive body 610. The wire electrode 623 is made of metal, and stretched inside the shield case 621 in a direction of the rotation axis of the photosensitive body 610. The grid electrode 625 includes a plurality of slits or holes arranged in a matrix manner. The grid electrode 625 is attached to the shield case 621 such that the grid electrode 625 is arranged between the wire electrode 623 and the photosensitive body 610 without any part of the shield case 621 between the wire electrode 623 and the photosensitive body 610. The charger 620 further includes a wire cleaner 627. The wire cleaner 627 is arranged so as to be slidable along the wire electrode 623. When the wire cleaner 627 is slid along the wire electrode 623, contaminants adhered to the wire electrode 623 are removed therefrom.

The developing unit 630 (FIG. 1) includes a toner box 631 accommodating toner, and a developing roller 632 which supplies the toner from the toner box 631 onto the surface of the photosensitive body 610. The transferring roller 640 is arranged to face the surface of the photosensitive body 610 with the endless belt 331 therebetween, and is used to transfer the toner on the surface of the photosensitive body 610 toward the endless belt 331.

When a voltage is applied to the wire electrode 623 of the charger 620, corona discharge is generated, and due to ions generated by the corona discharge, a surface of the photosensitive body 620 is uniformly charged to a positive polarity. At this stage, a charge potential of the photosensitive body 610 is controlled by controlling voltage applied to the grid electrode 625. Thereafter, as the laser beam L from the exposing unit 500 is applied on the charged surface of the photosensitive body 610, an electrostatic latent image is formed on the surface of the photosensitive body 610. As the toner is supplied, by the developing unit 630, onto the surface of the photosensitive body 610, the electrostatic latent image formed on the surface of the photosensitive body 610 is developed and a toner image is formed. The toner image formed on the surface of the photosensitive body 610 is transferred onto the sheet W or the sheet conveying surface of the belt 331 passing a position where the photosensitive body 610 and the transferring roller 640 face each other.

According to the present embodiment, the process unit 600K, the process unit 600Y, the process unit 600M and the process unit 600C are arranged in this order from an upstream side to a downstream side in the conveying direction of the sheet W. Therefore, a black toner image, a yellow toner image, a magenta toner image and a cyan toner image are sequentially transferred onto the sheet W in an overlapped manner.

According the present embodiment, the photosensitive body 610K corresponding to the black color is an example of a first photosensitive body, and the photosensitive bodies 600Y, 600M and 600C respectively corresponding to the Y, M and C colors are examples of second photosensitive bodies. Further, the charger 620K corresponding to the black color is an example of a first charger, and the chargers 620Y, 620M and 620C respectively corresponding to the Y, M and C colors are examples of second chargers. Further, the developing unit 630K corresponding to the black color is an example of a first developing device, and the developing units 630Y, 630M and 630C respectively corresponding to the Y, M and C colors are examples of second developing devices.

The fixing unit 700 is arranged on a downstream side, in the conveying direction of the sheet W, with respect to all the photosensitive bodies 610, and serves to fix the toner images, which are transferred onto the sheet W, permanently to the sheet W, thereby an image being formed on the sheet W. The discharge roller pair 130 discharges the sheet W passed through the fixing unit 700 to the discharge tray 120 via the discharge port 110.

Figure 4:
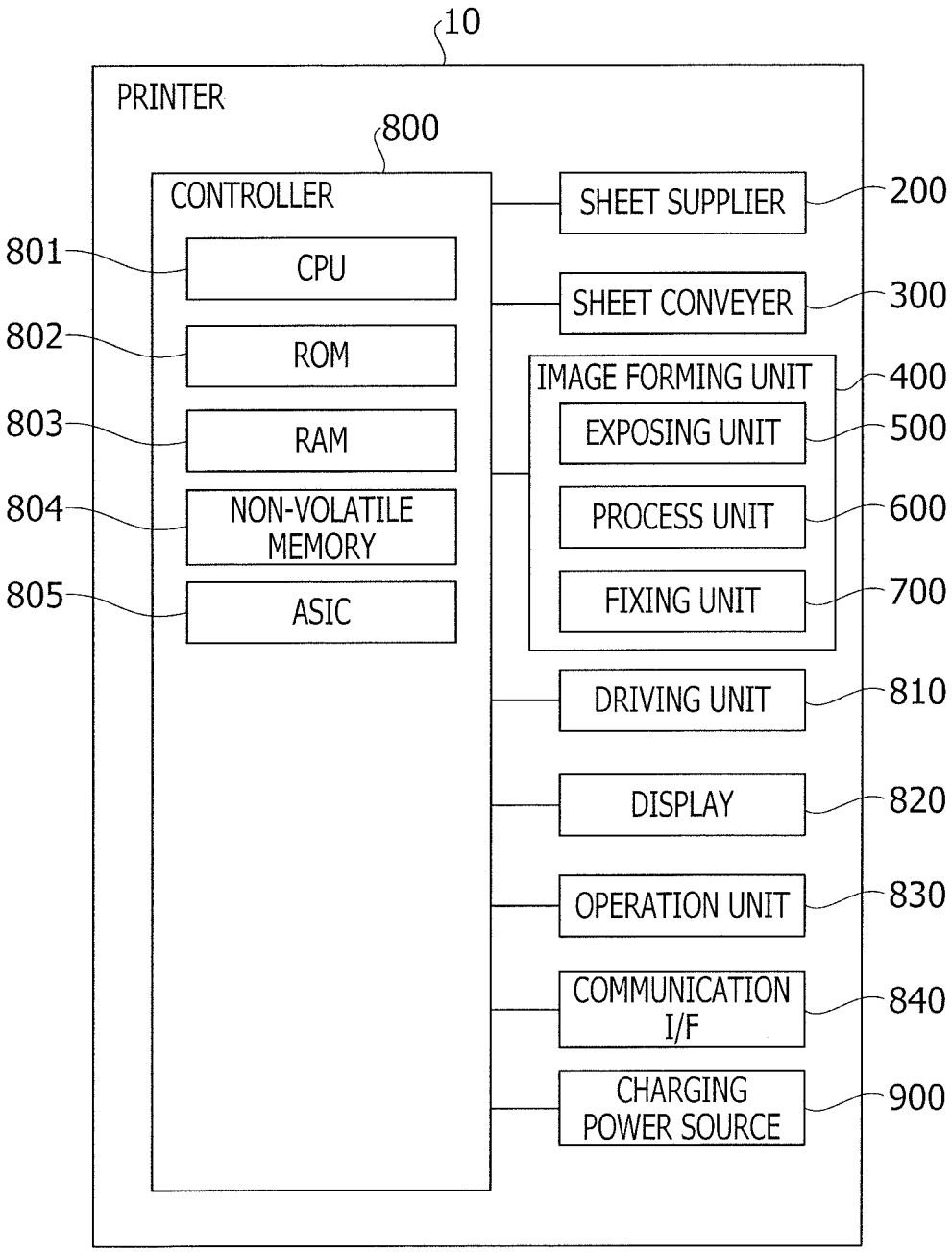
FIG. 4 is a block diagram showing an electrical configuration of the printer according to the embodiment of the disclosures.

FIG. 4 is a block diagram showing an electrical configuration of the printer 10. The printer 10 includes a controller 800, a controller 800, a driving unit 810, a display 820, an operation unit 830, a communication interface (I/F) 840 and a charging power source 900 as well as the sheet supplier 200, the sheet conveyer 300 and the image forming unit 400 described above.

The controller 800 has a CPU 801, a ROM 802, a RAM 803, a non-volatile memory 804 and ASIC 805. The ROM 802 stores control programs, setting information and the like, which are used to control operation of the printer 10. The RAM 803 is used as a work area and a temporary storage for data when the CPU 801 executes programs. The non-volatile memory 804 is a rewritable memory such as a NVRAM, a flash memory, an HDD, EEPROM or the like. The ASIC 805 is a hardware circuit mainly used for image processing. The CPU 801 controls respective components of the printer 10 by executing control programs retrieved from the ROM 802 in accordance with signals transmitted from sensors. The controller 800, the CPU 801 or the ASIC 805 is an example of a controller.

The driving unit 810 includes one or more motors (not shown), and drives the pickup roller 220, the registration roller pair 320, the driving roller 332, the photosensitive body 610, the developing roller 632 and the like to rotate with use of driving force of the one or more motors. The display 820 may be a liquid crystal display (LCD) and displays various information in accordance with instructions by the controller 800. The display 820 is an example of a notifying unit. The operation unit 830 is provided with keys acquiring user operations. The communication I/F 840 enables the printer 10 to communicate with external devices. The communication I/F 840 may be a network interface, a serial communication interface, a parallel communication interface or the like.

Figure 5:
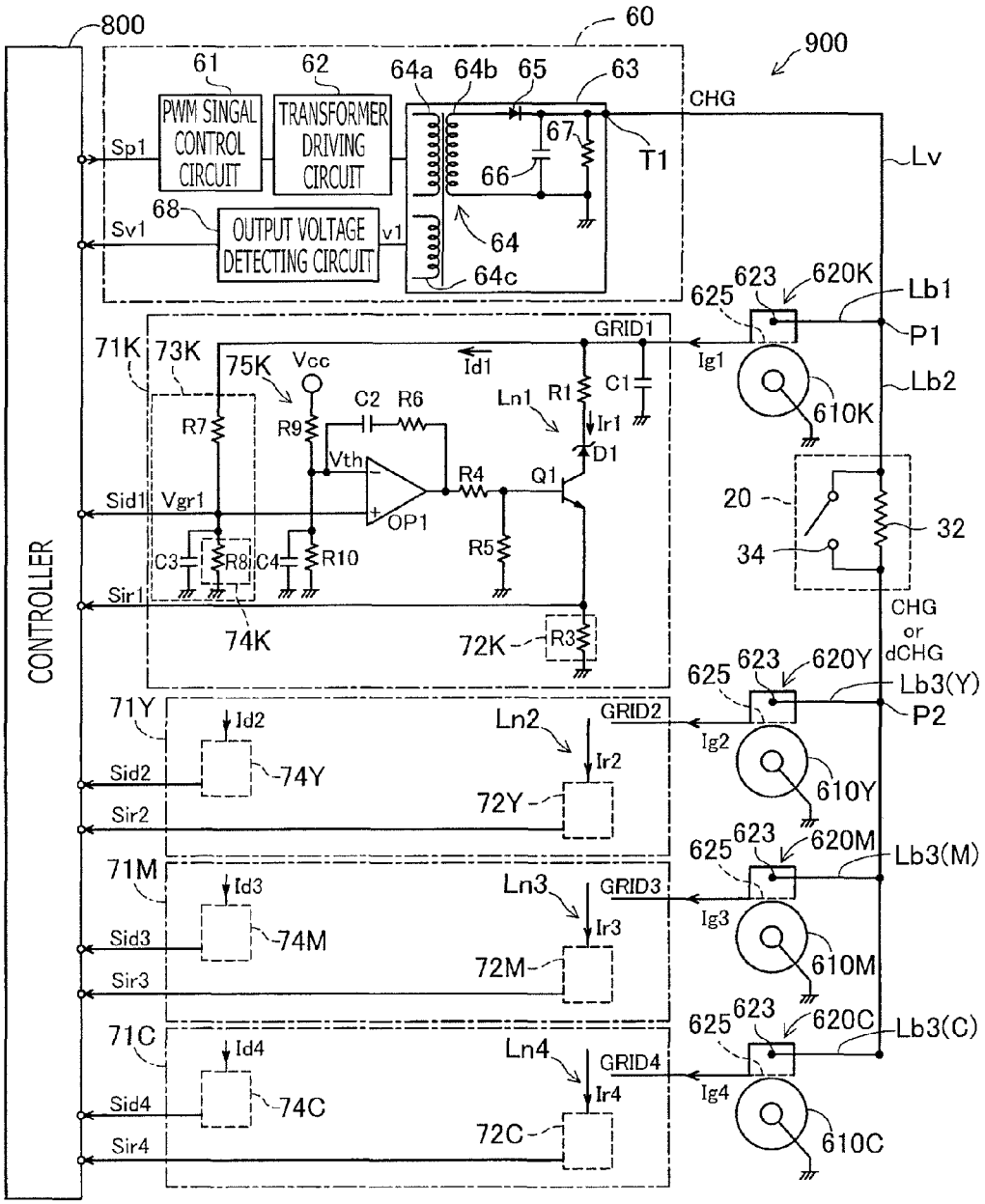
FIG. 5 shows a circuit configuration of a charging power source according to the embodiment of the disclosures.

The charging power source 900 is a circuit configured to supply electrical power to respective chargers 620. As shown in FIG. 5, the charging power source 900 has a single voltage outputting circuit 60. The voltage outputting circuit 60 generates and outputs a voltage. The voltage is to be applied to the wire electrode 623 of each charger 620K, 620Y, 620M and 620 C where each wire electrode 623 is electrically connected in parallel. The voltage outputting circuit 60 includes a PWM (pulse width modulation) signal controlling circuit 61, a transformer driving circuit 62, a voltage boosting circuit 63, and an output voltage detecting circuit 68.

The PWM signal controlling circuit 61 includes a resistor and a capacitor (not shown) for smoothing the PWM signal Sp1 from the controller 800. Then, the PWM signal controlling circuit 61 outputs the smoothed PWM signal Sp1 to the transformer driving circuit 62. The transformer driving circuit 62 causes flow of an oscillating current through a primary winding 64*a* of the transformer 64 included in the voltage boosting circuit 63 based on the smoothed PWM signal Sp1. The voltage boosting circuit 63 includes the transformer 64, a rectifier diode 65, a smoothing capacitor 66 and an output resistor 67. The transformer 64 has a primary winding 64*a*, a secondary winding 64*b* and an auxiliary winding 64*c*. A number of turns of the second winding 64*b* is greater than a number of turns the primary winding 64*a*. In the voltage boosting circuit 63, a voltage across the primary winding 64*a* is boosted in accordance with a winding ratio of the primary winding 64*a* and the secondary winding 64*b*. The voltage across the secondary winding 64*b* is rectified and smoothed by the rectifier diode 65 and the smoothing capacitor 66, and the rectified and smoothed voltage is an output voltage CHG of the voltage boosting circuit 63. The output voltage CHG is output from an output terminal T1 of the voltage outputting circuit 60. Incidentally, when the voltage is boosted by the transformer 64, a voltage v1 correlated to the output voltage CHG is generated across the auxiliary winding 64*c*.

The output voltage detecting circuit 68 includes a smoothing circuit and a voltage dividing resistor, and is connected to the auxiliary winding 64*c* of the transformer 64. The output voltage detecting circuit 68 smoothes and divides the voltage v1 generated across the auxiliary winding 64*c* to generate a voltage detection signal Sv1 corresponding to the amplitude of the output voltage CHG. The voltage detection signal Sv1 thus generated is supplied to the controller 800.

The charging power source 900 further includes a voltage output line Lv connected to the output terminal T1, a first branch line Lb1 connecting a first point P1 on the voltage output line Lv with the wire electrode 623 of the charger 620K, a second branch line Lb2 connecting the first point P1 with a second point P2, and third branch lines Lb3 connecting the second point P2 with wire electrodes 623 of the chargers 620Y, 620M and 620C, respectively. Specifically, the third branch lines Lb3 include the branch line Lb3(Y) connecting the second point P2 with the wire electrode 623 of the charger 620Y, the branch line Lb3(M) connecting the second point P2 with the wire electrode 623 of the charger 620M, and the branch line Lb3(C) connecting the second point P2 with the wire electrode 623 of the charger 620C.

On the second branch line Lb2 a voltage dropping circuit 20 is arranged. The voltage dropping circuit 20 includes a resistor 32 and a switching element 34, which is connected to the resistance element 32 in parallel. The switching element 34 is configured to switch a connection between a connecting state and a disconnecting state. The switching element 34 may be a mechanical switch or a semiconductor switch.

Since the voltage outputting circuit 60 is connected to respective chargers 620 as described above, the output voltage CHG output by the output terminal T1 of the voltage boosting circuit 63 is applied to the wire electrode 623 of the charger 620K via the voltage output line Lv and the first branch line Lb1. Then, corona discharge is generated in the charger 620K and the corona discharge charges the surface of the photosensitive body 610K.

When the switching element 34 is in the connecting state, the output voltage CHG output by the voltage boosting circuit 63 bypasses the resistor 32 and is directly applied to the wire electrodes 623 of the respective chargers 620Y, 620M and 620C via the second branch line Lb2 and the third branch line Lb3. Then, corona discharge is generated in each of the chargers 620Y, 620M and 620C, and the corona discharge charges the surfaces of the respective photosensitive bodies 610Y, 610M and 610C.

When the switching element 34 is in the disconnecting state, the output voltage CHG output by the voltage boosting circuit 63 is dropped by the resistor 32 on the second branch line Lb2 to a dropped output voltage dCHG. The dropped output voltage dCHG is applied to the wire electrodes 623 of the respective chargers 620Y, 620M and 620C via the third branch line Lb3. It is noted an expression "the voltage is dropped" in the specification means that the absolute value of the voltage is decreased. When the dropped voltage dCHG is applied to the wire electrodes 623 of the respective chargers 620Y, 620M and 620C, corona discharge is generated in each of the chargers 620Y, 620M and 620C, and the corona discharge charges the surfaces of the respective photosensitive bodies 610Y, 610M and 610C. The above configuration can be achieved by employing the resistor 32 having an appropriate resistance value of the voltage dropping circuit 20. It is noted, however, since the absolute value of the dropped output voltage dCHG is less than the absolute value of the output voltage CHG, the absolute value of the charged potential of each photosensitive body 620 when the dropped output voltage dCHG is applied is less than that when the output voltage CHG is applied. It is noted that the output voltage CHG is an example of a first voltage, and the dropped output voltage dCHG is an example of a second voltage.

The charging power source 900 further includes four gird voltage applying circuits 71 respectively corresponding to the four chargers 620. Since the four grid voltage applying circuits 71 have the same configurations, a configuration of the grid voltage applying circuit 71K corresponding to black color (K) will be representatively described, and description of the other grid voltage applying circuits 71 corresponding to the other colors is omitted. It is also noted that, the configuration of the grid voltage applying circuit 71K is shown in FIG. 5 and configurations of the other grid voltage applying circuits 71Y, 71M and 71C are omitted in FIG. 5.

The grid voltage applying circuit 71K includes a voltage detecting circuit 73K, a voltage controlling circuit Ln1, and a feedback circuit 75K. In the following description, to distinguish the voltage controlling circuits Ln corresponding to K, Y, M and C colors from each other, one of the numerals 1-4 is suffixed after the reference letters "Ln", respectively. So are in indicating grid voltages GRID, grid currents Ig, divided currents Id, line currents Ir, voltages Vgr, divided current detection signals Sid, and line current detection signals Sir.

The voltage detecting circuit 73K includes voltage dividing resistors R7 and R8, and with use of the voltage dividing resistors R7 and R8, detects a voltage Vgr1 corresponding to the grid voltage GRID1 of the grid electrode 625.

The voltage dividing resistor R8 of the voltage detecting circuit 73K also serves as a divided current detecting circuit 74K which detects the divided current Id1 flowing through the voltage detecting circuit 73K. That is, the voltage dividing resistor R8 as the divided current detecting circuit 74K generates a divided current detection signal Sid1, which is a terminal voltage of the voltage dividing resistor R8 (which is equal to the voltage Vgr1) and supplies the thus generated divided current detection signal Sid1 to the controller 800. The controller 800 calculates the divided current Id1 based on a resistance value of the voltage dividing resistor R8 and the divided current detection signal Sid1. Further, the controller 800 calculates the grid voltage GRID1 based on the divided current detection signal Sid1 and a voltage dividing ratio defined by the resistance values of the voltage dividing resistors R7 and R8.

The voltage controlling circuit Ln1 is configured to adjust the grid voltage GRIM and includes a resistor R1, a Zener diode D1, a transistor Q1 and a resistor R3. A cathode of the Zener diode D1 is connected with the resistor R1, an anode of the Zener diode D1 is connected with a collector of the transistor Q1, and an emitter of the transistor Q1 is connected with the resistor R3.

The feedback circuit 75K includes an operational amplifier OP1, and performs a feedback control via the voltage controlling circuit Ln1 such that the voltage Vgr1 detected by the voltage detecting circuit 73K is equal to a reference voltage Vth. To a non-inverted input terminal of the operational amplifier OP1, the voltage Vgr1 is input. Further, to an inverse input terminal of the operational amplifier OP1, the reference voltage Vth, which is generated, by dividing a power source voltage Vcc (e.g., 5V) with use of voltage dividing resistors R9 and R10 is input. An output terminal of the operational amplifier OP1 and the inverted input terminal thereof are connected via a resistor R6 and a capacitor C2.

Further, the output terminal of the operational amplifier OP1 is connected to the base of the transistor Q1 via a resistor R4. Between the resistor R4 and the base of the transistor Q1, one terminal of a resistor R5 is connected, while the other terminal of the resistor R5 is grounded. As the base current of the transistor Q1 is controlled by the operation amplifier OP1, a voltage between the collector and emitter of the transistor Q1 is controlled, thereby the grid voltage GRID1 being adjusted. That is, the feedback circuit 75K varies the base current of the transistor Q1 so that the detection voltage Vgr1 coincides with the reference voltage Vth, thereby controlling the grid voltage GRID1.

The resistor R3 provided in the voltage controlling circuit Ln1 also serves as a line current detecting circuit 72K which detects a line current Ir1 flowing through the voltage controlling circuit Ln1 between the transistor Q1 and the GND. The line current detecting circuit 72K generates a line current detection signal Sir1 which is a terminal voltage of the resistor R3, and supplies the line current detection signal Sir1 to the controller 800. The controller 800 calculates a line current Ir1 based on the resistance value of the resistor R3 and the line current detection signal Sir1. Further, the controller 800 calculates a grid current Ig1 flowing through the grid electrode 625 by adding the above-described divided current Id1 to the line current Ir1. It is noted that the capacitors C1, C3 and C4 are charging capacitors, respectively, which delays the voltage generated across the corresponding resistors.

As described above, according to the present embodiment, the grid voltage GRID1-GRID4 of the grid electrodes 625 of respective chargers 620 are applied by the grid voltage applying circuits 71 which are provided corresponding to the respective chargers 620. Further, the controller 800 calculates the grid current Ig1-Ig4 flowing through the respective grid electrodes 625 of the chargers 620 based on divided current detection signals Sid1-Sid4 output by divided current detecting circuits 74 included in the respective grid voltage applying circuits 71. Generally, the wire current flowing through the wire electrode 623 of each charger 620 is divided into the discharge current for charging the photosensitive body 610 and the grid current Ig at a particular ratio. Therefore, the amplitude of the grid current Ig would be regarded as an index indicating the amplitude of the discharge current. It is noted that the divided current detecting circuit 74 and the line current detecting circuit 72 are examples of an electrical current detecting circuit that detects the grid current Ig.

Next, a charge controlling process will be described. The charge controlling process is part of an image forming process to form an image on the sheet W. The charge controlling process is to control a charging status of each photosensitive body 610 by controlling the voltage applied to respective chargers 620. When the controller 800 receives a print instruction to form an image on the sheet W through the communication I/F 840 or the operation unit 830, the controller 800 starts the charge controlling process. It is noted that processes included in the image forming process other than the charge controlling process are well-known processes and detailed description thereof is omitted.

Figure 6:
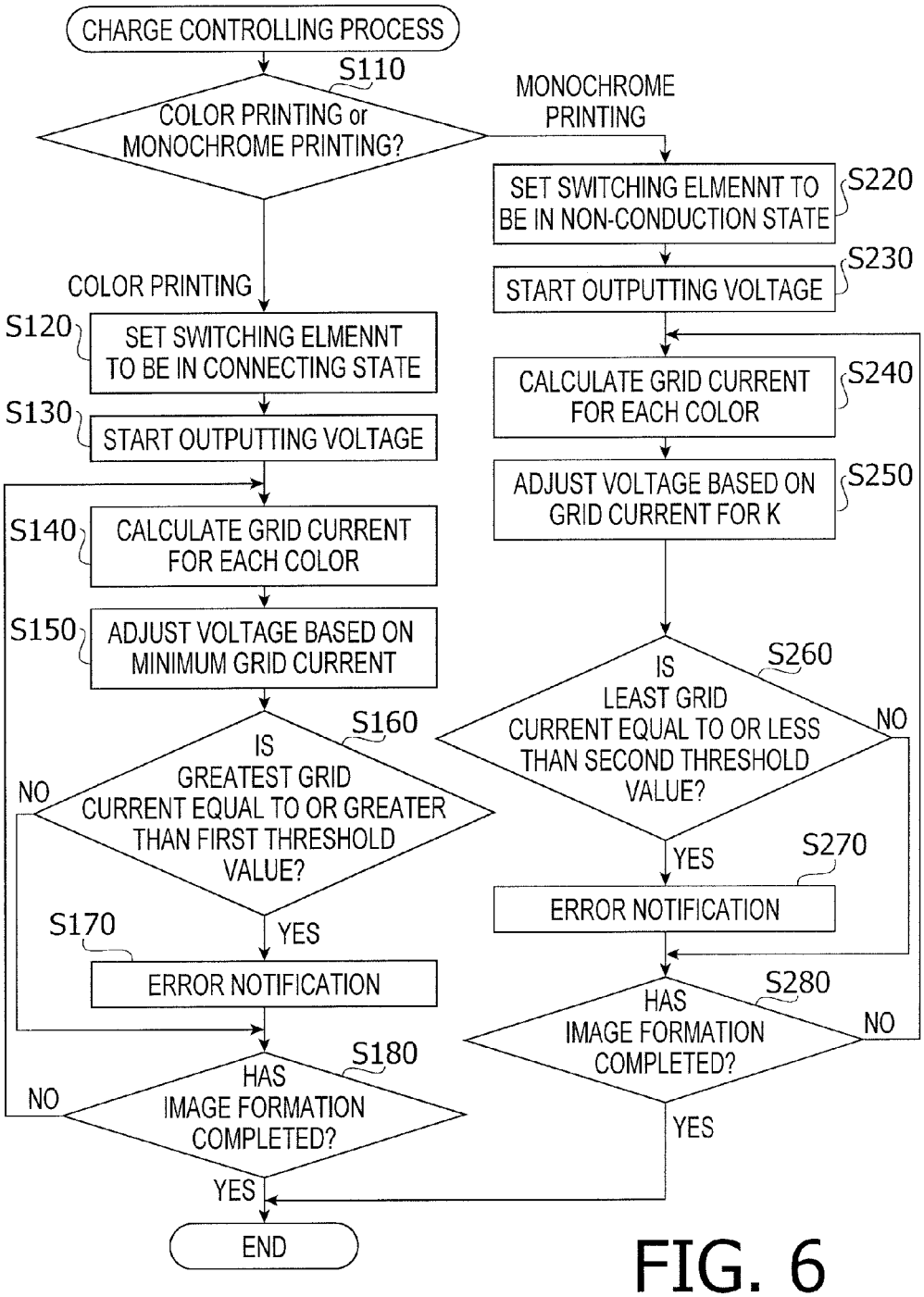
FIG. 6 is a flowchart illustrating a charge controlling process according to the embodiment of the disclosures.

FIG. 6 is a flowchart illustrating the charge controlling process. When the charge controlling process is started, the controller 800 firstly determines whether a received print instruction is an instruction of color printing to form an image using four colors (K, Y, M and C) or an instruction of monochrome printing to form an image using only the black color (S110). When it is determined in S110 that the instruction is of the color printing, the controller 800 brings the switching element 34 in the connecting state (S120). Further, the controller 800 supplies the PWM signal Sp1 to the voltage outputting circuit 60 so that the voltage outputting circuit 60 starts outputting the output voltage CHG (S130). At this stage, the output voltage CHG output by the voltage outputting circuit 60 is applied to wire electrodes 623 of the chargers 620K, 620Y, 620M and 620C, respectively. As the output voltage CHG is applied to the wire electrodes 623, each of the chargers 620K, 620Y, 620M and 620C generates corona discharge, thereby the photosensitive bodies 610K, 610Y, 610M and 610C are charged, respectively. At this stage, the grid voltages GRID1-GRID4 are substantially the same.

Thereafter, the controller 800 calculates the grid currents Ig1-Ig4 in the chargers 620 corresponding to the four colors, respectively (S140). Then, based on the least grid current Ig among the four grid currents Ig1-Ig4, the controller 800 adjusts the output voltage CHG of the voltage outputting circuit 60 (S150). Specifically, the controller 800 adjusts output voltage CHG by controlling the duty ratio of the PWM signal so that the least grid current Ig is equal to a particular value. On the wire electrodes 623 of the chargers 620, contaminants are adhered as each electrode 623 generates corona discharge. There is a tendency that the grid currents Ig of the chargers 620 decrease as contamination increases. Therefore, it is understood that the charger 620 having the least grid current Ig has the wire electrode 623 be contaminated most. By adjusting the output voltage CHG so that the least grid current Ig becomes the particular value, the gird currents Ig in all chargers 620 can be maintained to be equal to or greater than the particular value, thereby the absolute values of the charged potentials of the photosensitive bodies 610 can be maintained to be equal to or greater than a particular value.

If the degree of contamination of the wire electrode 623 varies largely among the chargers 620, adjusting the output voltages CHG based on the least grid current Ig as in S150 may cause the grid current Ig of the charger 620 having the wire electrode 623 be relatively less contaminated to be excessively large since the output voltage CHG is adjusted based on the grid current Ig of the charger 620 having the wire electrode 623 be relatively more contaminated. If the grid current Ig in the charger 620 corresponding to a certain color is excessively large, the discharge current corresponding to the charger 620 corresponding to the certain color may also be excessively large. Therefore, in such a case, an error notifying process is executed as described below.

In S160, the controller 800 determines whether the greatest grid current Ig among the grid current Ig1-Ig4 of the chargers 620 is equal to or greater than a first threshold value.

When it is determined that the greatest gird current Ig is equal to or greater than the first threshold value (S160: YES), the controller 800 executes an error notifying process (S170). The error notifying process is a process of displaying a message encouraging the user to clean the wire electrodes 623 of the chargers 620 with the wire cleaners 627. If the controller 800 determines that the greatest grid current Ig is smaller than the first threshold value (S160: NO), the controller 800 skips the error notifying process.

Next, the controller 800 determines whether the image forming process has been completed (S180). While it is determined that the image forming process has not been completed (S180: NO), the controller 800 repeats the above described processes S140-S170 until the controller determines that the image forming process has been completed. When it is determined that the image forming process has been completed (S180: YES), the controller 800 terminates the charge controlling process.

When it is determined that the print instruction is of the monochrome printing in S110, the controller 800 brings the switching element 34 to the disconnecting state (S220). Further, the controller 800 supplies the PWM signal Sp1 to the voltage outputting circuit 60 so that the voltage outputting circuit 60 starts outputting the output voltage CHG (S230). In this state, the output voltage CHG output by the voltage outputting circuit 60 is applied to the wire electrode 623 of the charger 620K to be used for printing, while the dropped output voltage dCHG, which is generated by the voltage dropping circuit 20 is applied to the wire electrodes 623Y, 623M and 623C. In the charger 620K, the corona discharge is generated as the output voltage CHG is applied to the wire electrode 623, thereby the corresponding photosensitive body 610 is charged. In the chargers 620Y, 620M and 620C, the corona discharge is generated as the dropped output voltage dCHG is applied to the wire electrodes 623 of the chargers 620Y, 620M and 620C, thereby the corresponding photosensitive bodies 610 are charged. It is noted that, since the dropped output voltage dCHG is less than the output voltage CHG, and the grid voltage applying circuits 71Y, 71M and 71C cannot maintain the grid voltage GRID2-GRID 4 as the same value as the grid voltage GRID1, the absolute values of the charged potentials of the photosensitive bodies 610Y, 610M and 610C are less than that of the photosensitive body 610K.

Thereafter, the controller 800 calculates the grid currents Ig1-Ig4 corresponding to respective colors (S240), and adjusts the output voltage CHG of the voltage outputting circuit 60 (S250) based on the grid current Ig1 in the charger 620K. That is, the controller 800 adjusts the output voltage CHG by adjusting the duty ratio of the PWM signal Sp1 so that the grid current Ig1 coincides with the particular value. By this control, the grid current Ig1 in the charger 620K is maintained to be the particular value, and the absolute value of the charged potential of the photosensitive body 610K is maintained to an appropriate value. It is noted that each of the grid currents Ig in the other chargers 620Y, 620M and 620C has a value equal to or less than the grid current Ig1 of the charger 620K.

The controller 800 is configured to determine whether the least current Ig among the four grid currents Ig1-Ig4 is equal to or less than the second threshold value (S260). If it is determined that the least current Ig is equal to or less than the second threshold value (S260: YES), the controller 800 executes an error notifying process (S270). The error notifying process is a process of displaying a message encouraging a user to clean the wire electrodes 623 with the wire cleaners 627. Some of the wire electrodes 623 of the chargers 620 may be less contaminated and some may be more contaminated while the output voltage CHG is adjusted based on the grid voltage Ig of the charger 620K in S250 Thus the grid current Ig of the more contaminated wire electrode 623 may be very little. When the grid current Ig in one of the charger 620Y, 620M and 620C is very little, the discharge current is also very little, and the absolute value of the charged potential of the photosensitive body 610K becomes very little. When the absolute value of the charged potential of one of the photosensitive bodies 610Y, 610M and 610C is very little, toner may be unnecessarily adhered to the one of the photosensitive bodies 610Y, 610M and 610C. Therefore, in such a case, the error notifying process (S270) described above is executed. When it is determined that the least grid current Ig is greater than the second threshold value (S260: NO), the controller 800 skips the error notifying process (S270).

Next, the controller 800 determines whether the image forming process has been completed (S280). When it is determined that the image forming process has not been completed (S280: NO), the controller 800 repeats the above-described processes S240, S250, S260 and S270 until the controller 800 determines that the image forming process has been completed (S280: YES). When it is determined that the image forming process has been completed (S280: YES), the controller 800 terminates the charge controlling process.

As described above, in the printer 10 according to the present embodiment, a single voltage outputting circuit 60 is provided for the four chargers 620 which are connected in parallel, and the output voltage CHG of the voltage outputting circuit 60 is applied to each of the four chargers 620. Therefore, the printer 10 may include less number of parts rather than the conventional printer, thereby being downsized. Further, the printer 10 according to the embodiment is available for a first charging control and a second charging control, where the first charging control is that the controller 800 applies the output voltage CHG to each of the wire electrodes 623 of the chargers 620 K, 620Y, 620M and 620C, and where the second charging control is that the controller 800 applies the output voltage CHG to the wire electrode 623 of the charger 620K, and applies the dropped output voltage dCHG to each of the wire electrodes 623 of the chargers 620Y, 620M and 620C.

As described above, in the printer 10 according to the present embodiment, the controller 800 executes the first charging control when the four colors are used for image formation, each photosensitive body 610 used for the image formation can be appropriately charged. Further, when only one color (i.e., the K color) is used for image formation, the controller 800 executes the second charging control. Therefore, in the second charging control, the photosensitive body 610K used for the image formation can be appropriately charged, while the dropped output voltage dCHG is applied to the chargers 620Y, 620M and 620C which are not used for the image formation, thereby power consumption by these chargers 620Y, 620M and 620C may be reduced.

Further, in the printer 10 according to the present embodiment, as the controller 800 executes the second charging control, the voltage applied to the chargers 620Y, 620M and 620C which are not used for image formation is dropped, deterioration of the chargers 620Y, 620M and 620C can be reduced, and generation of ozone by the chargers 620Y, 620M and 620C can be reduced.

It is noted that, if the chargers 620Y, 620M and 620C, which are not used for image formation, are disconnected from the voltage outputting circuit 60 in some way when the monochrome printing is executed, the wire electrode 623 of the charger 620K is only contaminated. Therefore, the wire electrodes 623 of the chargers 620Y, 620M and 620C may not be contaminated when the monochrome printing is executed. Then, when the color printing is executed after the monochrome printing is executed, the discharge potentials of the photosensitive bodies 610K, 610Y, 610M and 610C may be largely vary, thereby causing quality of the color images to be poor. In the printer 10 according to the present embodiment, corona discharge generated in the chargers 620Y, 620M and 620C may cause the contamination of the wire electrodes 623 of the chargers 620Y, 620M and 620C when the monochrome printing is executed. Therefore, difference of degrees of contaminations of the wire electrodes 623 among the chargers 620K, 620Y, 620M and 620C can be reduced, thereby deterioration of image quality can be reduced.

In the printer 10 according to the embodiment, the charging power source 900 has the voltage output line Lv connected to the output terminal T1 of the voltage outputting circuit 60, the first branch line Lb1 which connects a first point P1 on the voltage output line Lv with the charger 620K, the second branch line Lb2 connecting the first point P1 on the voltage output line Lv with a second point P2, and a third branch line Lb3 connecting the second point P2 with each of the chargers 620Y, 620M and 620C respectively. Further, the voltage dropping circuit 20 is arranged on the second branch line Lb. Therefore, according to the printer 10, the voltage dropping circuit 20 is arranged on an upstream side (i.e., on the voltage outputting circuit 60 side) with respect to the chargers 620Y, 620M and 620C, which are connected in parallel, thereby the circuit configuration being simplified.

In the printer 10 according to the embodiment, the voltage dropping circuit 20 includes a resistor 32, and a switching element 34 connected in parallel with the resistor 32. The controller 800 causes the switching element 34 to be in the connecting state in the first charging control, while causes the switching element 34 to be in the disconnecting state in the second charging control. Therefore, in the printer 10 according to the embodiment, the controller 800 applies the output voltage CHG to the chargers 620Y, 620M and 620C as well as the charger 620K in the first charging control. Further, the controller 800 applies the output voltage CHG to the charger 620K, while applies the dropped output voltage dCHG to the chargers 620Y, 620M and 620C in the second charging control.

In the printer 10 according to the embodiment, each charger 620 includes the wire electrode 623 serving as a discharging electrode, and the grid electrode 625 facing the wire electrode 623. Further, the charging power source 900 includes the divided current detecting circuit 74 and the line current detecting circuit 72, which serve as a current detecting circuit to detect the grid current Ig flowing through the grid electrode 625.

The controller 800 changes the output voltage CHG of the voltage outputting circuit 60 based on the grid current Ig in the first charging control and the second charging control. Therefore, in the printer 10 according to the embodiment, by adjusting the grid current Ig to be an appropriate value, the discharge current can also be adjusted to be an appropriate value. Accordingly, the charging potential of each photosensitive body 610 can be adjusted to be an appropriate value.

Specifically, the controller 800 causes the voltage outputting circuit 60 to change the output voltage CHG based on the least grid current Ig of the grid currents Ig1-Ig4 in the chargers 620K, 620Y, 620M and 620C in the first charging control. Further, the controller 800 causes the voltage outputting circuit 60 to change the output voltage CHG based on the grid current Ig1 in the charger 620K in the second charging control.

According to the above configuration, the printer 10 is enabled to adjust the voltage applied to each charger 620 so that each of the photosensitive bodies 610 is charged appropriately in the first charging control, and is also enabled to adjust the voltage applied to the charger 620K so that the photosensitive body 610K is charged appropriately.

In the printer 10 according to the present embodiment, the controller 800 executes the error notifying process in which a message encouraging the user to clean the wire electrodes 623 of the chargers 610 with the wire cleaners 627 when it is determined, in the second charging control, that the least grid current Ig of the grid currents Ig1-Ig4 in the chargers 620K, 620Y, 620M and 620C is equal to or less than the second threshold value. Therefore, in the printer 10 according to the present embodiment, even if only the K color is used for image formation, when one of the grid currents Ig in the chargers 620Y, 620M and 620C is the least value, the message for encouraging cleaning of the wire electrodes 623 is displayed. Therefore, the grid current Ig in one of the chargers 620Y, 620M and 620C is very little, and then the absolute value of the charge potential of the photosensitive body 610 of the one of the chargers 620Y, 620M and 620C is very little, thereby the toner is less adhered on the photosensitive body 610 of the one of the chargers 620Y, 620M and 620C, and the image quality may not get poor.

Figure 7:
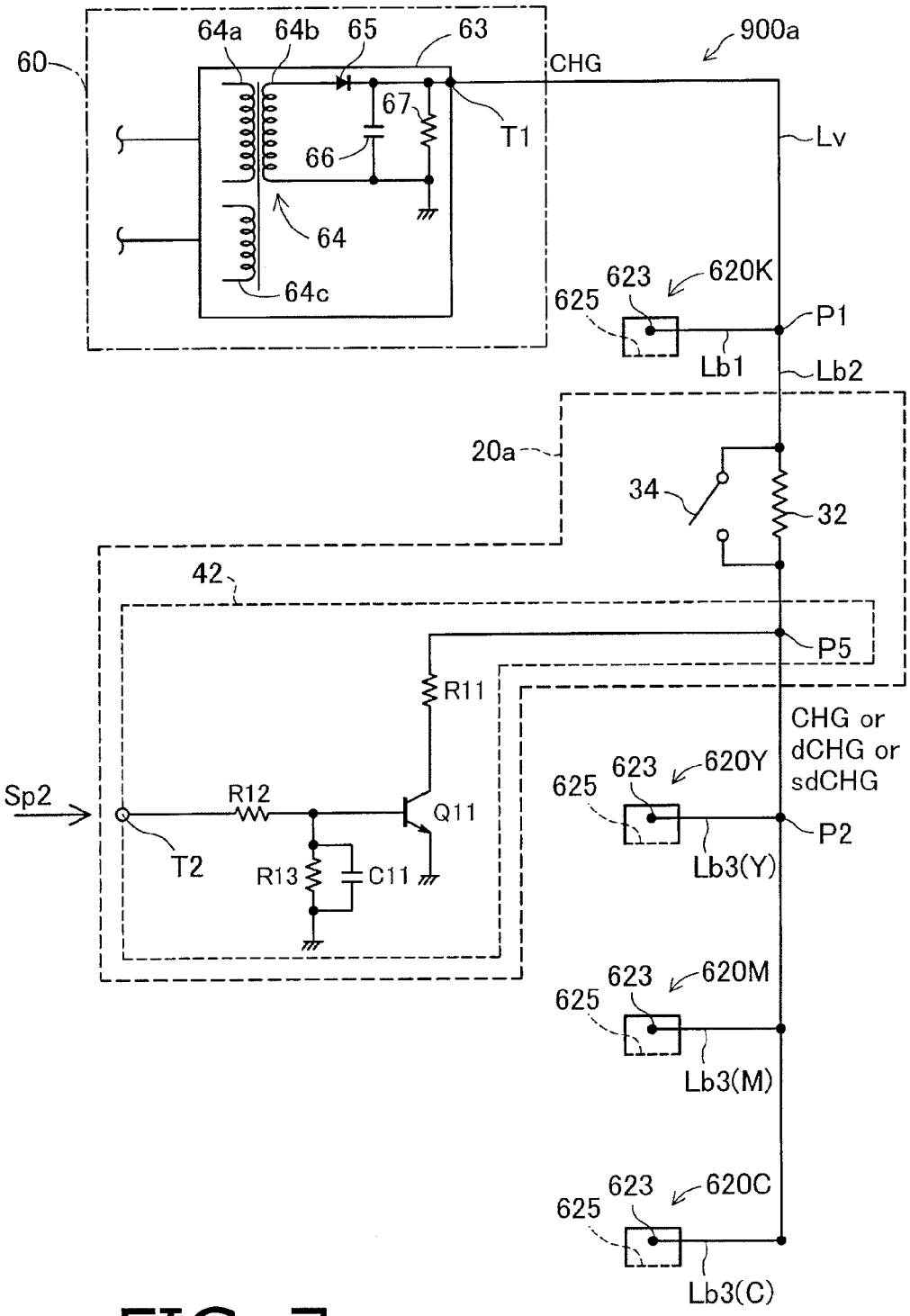
FIG. 7 shows a circuit configuration of a first modification of the charging power source according to the embodiment of the disclosures.

FIG. 7 shows a charging power source 900*a* which is a first modification of the above-described embodiment. The charging power source 900*a* according to the first modification has a voltage dropping circuit 20*a* different from the voltage dropping circuit 20 of the charging power source 900 shown in FIG. 5. It is noted that the charging power source 900*a* other than the voltage dropping circuit 20*a* has the same configuration as the charging power source 900 shown in FIG. 5 and the same reference numbers are assigned, but detail description is omitted. Further, in FIG. 7, electrical components other than the voltage dropping circuit 20*a* are appropriately omitted.

The voltage dropping circuit 20*a* of the charging power source 900*a* according to the first modification shown in FIG. 7 includes a voltage adjusting circuit 42 configured to adjust the voltage to be applied to the wire electrodes 623 of the chargers 620Y, 620M and 620C in addition to the resistor 32 and the switching element 34. The voltage adjusting circuit 42 has a transistor Q11, resistors R11, R12 and R13, and a condenser C11. A collector of the transistor Q11 is connected, via the resistor R11, to a fifth point P5, which is located on the second point P2 side with respect to the resistor 32 on the second branch line L2. A base of the transistor Q11 is connected, via the resistor R12, to a terminal T2 of the voltage adjusting circuit 42. To the terminal T2, the PWM signal Sp2 serving as a voltage controlling signal is supplied from the controller 800.

The controller 800 causes the switching element 34 to be in the connecting state and sets the duty ratio of the PWM signal Sp2 to be a first value which is a relatively large value, in the first charging control. With this control, the output voltage CHG output by the voltage outputting circuit 60 is applied, as it is, to the wire electrode 623 of each of the chargers 620Y, 620M and 620C. Further, the controller 800 causes the switching element 34 to be in the disconnecting state and sets the duty ratio of the PWM signal Sp2 to a second value, which is smaller than the first value, in the second charging control. Then, the output voltage CHG output by the voltage outputting circuit 60 is dropped to the dropped output voltage dCHG by the resistor 32 of the voltage dropping circuit 20. The dropped output voltage dCHG is further dropped to the second dropped output voltage sdCHG by the voltage adjusting circuit 42, and the second dropped output voltage sdCHG is applied to the wire electrodes 623 of the chargers 620Y, 620M and 620C. It is noted that, by adjusting the duty ratio of the PWM signal Sp2, the voltage applied to the wire electrodes 623 of the chargers 620Y, 620M and 620C can be adjusted.

As described above, according to the first modification, since the voltage dropping circuit 20*a* of the charging power source 900*a* includes the voltage adjusting circuit 42, the amplitude of the voltage applied to the chargers 620Y, 620M and 620C can be restricted when only the K color is used for image formation.

It is noted that the PWM signal Sp2 of which duty ratio is set to the first value is an example of a first voltage controlling signal, and the PWM signal Sp2 of which duty ratio is set to the second value is an example of a second voltage controlling signal. As an alternative configuration, a pulse signal of which value switches between an H (high) level and an L (low) level may be applied to the terminal T2 of the voltage adjusting circuit 42 instead of the PWM signal Sp2. In such an alternative configuration, the pulse signal may be switched to the H level in the first charging control, while switched to the L level in the second charging control.

Figure 8:
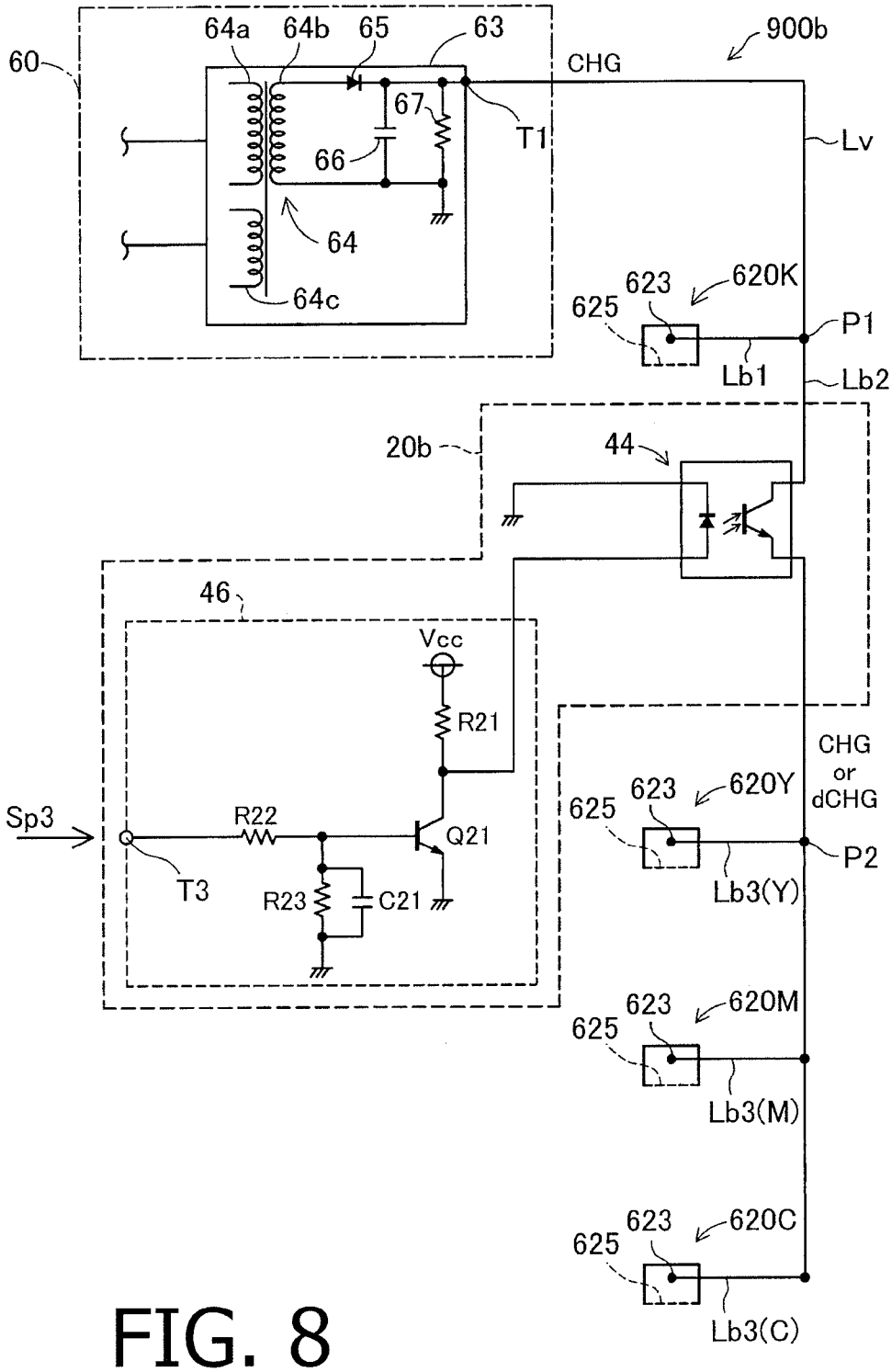
FIG. 8 shows a circuit configuration of a second modification of the charging power source according to the embodiment of the disclosures.

FIG. 8 shows a charging power source 900*b* according to a second modification of the above-described embodiment. In the second modification, a configuration of a voltage dropping circuit 20*b* is different from the voltage dropping circuit 20 shown in FIG. 5. The other parts of the charging power source 900*b* are the same as those of the charging power source 900 shown in FIG. 5, the same reference numbers are assigned, while the detail description of the charging power source 900*b* is omitted. It is also noted that, in FIG. 8, some parts of the charging power source 900*b* other than the voltage dropping circuit 20*b* will be appropriately omitted.

The voltage dropping circuit 20*b* of the charging power source 900*b* according to the second modification shown in FIG. 8 includes a photocoupler 44 and a light emission adjusting circuit 46. A phototransistor of the photocoupler 44 is arranged on the second branch line Lb2, and the light emission adjusting circuit 46 is connected to a light emission diode of the photocoupler 44. The light emission adjusting circuit 46 includes a reference power supply Vcc, a transistor Q2, resistors R21, R22 and R23 and a capacitor C21. A collector of the transistor Q21 is connected to the reference power supply Vcc via the resistor R21. A base of the transistor Q21 is connected to a terminal T3 of the light emission adjusting circuit 46 via the resistor R22. To a terminal T3, the PWM signal Sp3 serving as the voltage controlling signal is supplied from the controller 800.

The controller 800 sets the duty ratio of the PWM signal Sp3 to 100% in the first charging control. With this setting, a relatively large amount of voltage is applied to the light emitting diode of the photocoupler 44, and the output voltage CHG output by the voltage outputting circuit 60 is applied, at it is, to the wire electrode 623 of each of the chargers 620Y, 620M and 620C. In the second charging control, the controller 800 sets the duty ratio of the PWM signal Sp3 to a value less than 100%. With this setting, the output voltage CHG output by the voltage outputting circuit 60 is dropped to the dropped output voltage dCHG by the photocoupler 44 of the voltage dropping circuit 20*b*, and the dropped output voltage dCHG is applied to the wire electrode 623 of each of the chargers 620Y, 620M and 620C. By adjusting the duty ratio of the PWM signal Sp3, the voltage applied to the wire electrode 623 of each of the chargers 620Y, 620M and 620C can be adjusted.

As described above, according to the second modification, since the voltage dropping circuit 20*b* of the charging power source 900*b* includes the photocoupler 44 and the voltage adjusting circuit 46, the amplitude of the voltage applied to the chargers 620Y, 620M and 620C can be restricted when only the K color is used for image formation.

It is noted that the PWM signal Sp3 of which duty ratio is set to 100% is an example of a first voltage controlling signal, and the PWM signal Sp3 of which duty ratio is set to a value less than 100% is an example of a second voltage controlling signal. As an alternative configuration, a pulse signal of which value switches between an H (high) level and an L (low) level may be applied to the terminal T3 of the voltage adjusting circuit 46 instead of the PWM signal Sp3. In such an alternative configuration, the pulse signal may be switched to the H level in the first charging control, while switched to the L level in the second charging control.

Figure 9:
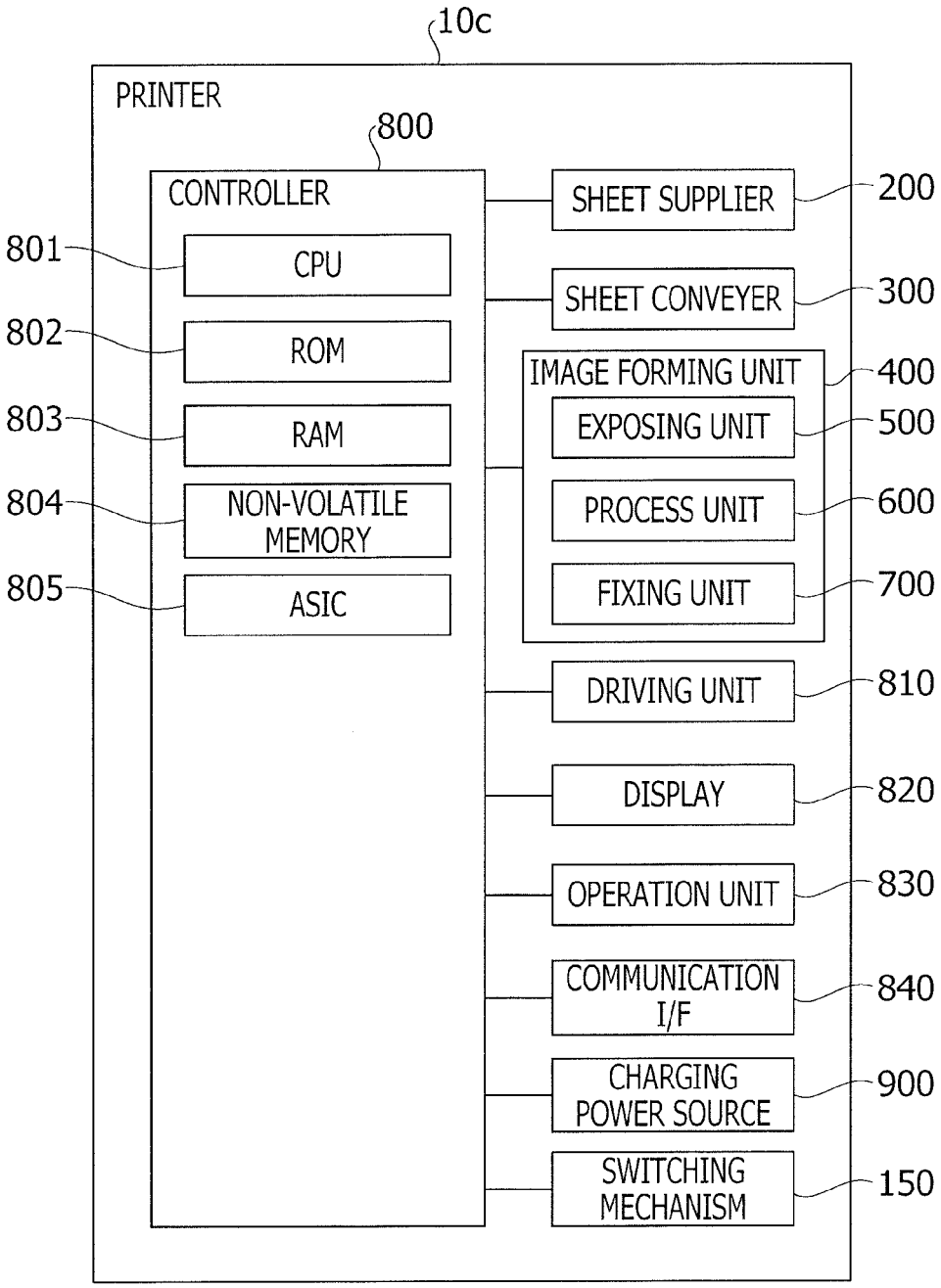
FIG. 9 is a block diagram showing an electrical configuration of a printer according to a modified embodiment of the disclosures.

FIG. 9 shows a block diagram of a printer 10*c* according to a modified embodiment of the disclosures. It is noted that the printer 10*c* shown in FIG. 9 is different from the printer 10 shown in FIG. 4 in that the printer 10*c* has a switching mechanism 150. Since the other parts of the printer 10*c* shown in FIG. 9 are the same as those of the printer 10 shown in FIG. 4, the same reference numerals are assigned, while the detail description of the printer 10*c* is omitted.

Figure 10A:
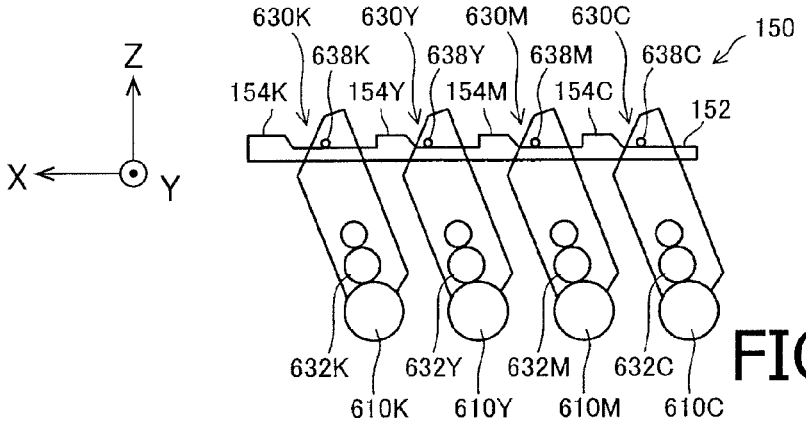
FIGS. 10A-10C illustrate a configuration of a switching mechanism according to the embodiment of the disclosures.
Figure 10B:
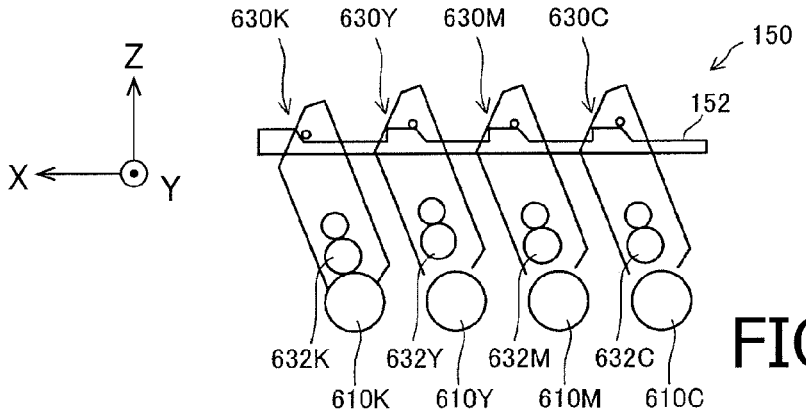
Figure 10C:
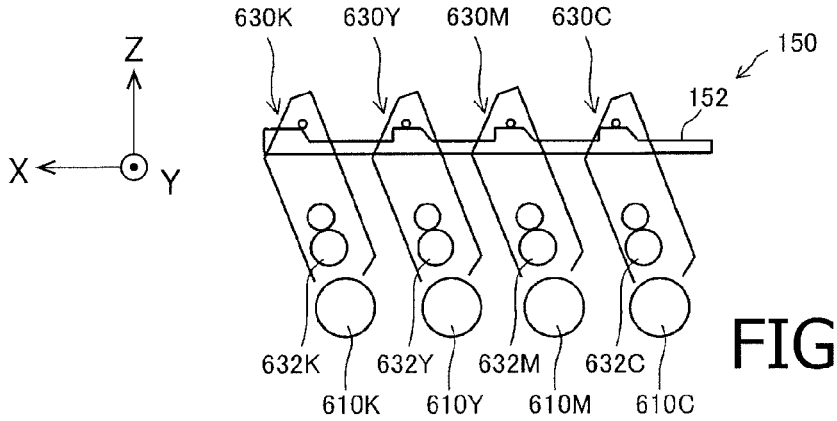

In the modified embodiment shown in FIG. 9, each of the developing units 630 for respective colors is configured to be movable between a contact position and a spaced position as shown in FIGS. 10A-10C. At the contact position the developing rollers 632 of the developing units 630 contact the corresponding photosensitive bodies 610. At the space position the developing rollers 632 of the developing units 630 is spaced from the corresponding photosensitive bodies 610. The switching mechanism 150 is configured to move each of the developing units 630 between the contact position and the spaced position.

As shown in FIGS. 10A-10C, each of the developing units 630 is provided with a protrusion 638. The switching mechanism 150 has a translation cam 152 which extends in a front-rear direction (i.e., in the X axis direction) across the developing units 630 of the respective colors. The translation cam 152 has a push-up part 154K, a push-up part 154Y, a push-up part 154M and a push-up part 154C corresponding to the a protrusion 638K, a protrusion 638Y, a protrusion 638M and a protrusion 638C provided to the developing units 630 for respective colors.

As shown in FIG. 10A, when none of the push-up parts 154 of the translation cam 152 engages with the protrusion 638 of the corresponding developing unit 630, the developing units 630 corresponding to all the colors are located at the contact positions. As shown in FIG. 10B, when the push-up parts 154 corresponding to the Y, M and C colors engage with the protrusions of the corresponding developing unit 630 while the push-up part 154K does not engage with the protrusion 638K of the developing unit 630K, the developing unit 630K is located at the contact position while the developing units 630Y, 630M and 630C are located at the spaced positions. Further, as shown in FIG. 10C, when the push-up parts 154 corresponding to all the colors could engage with the protrusions of the corresponding developing unit 630, all the developing units 630 corresponding to all the colors are located at the spaced positions.

When the color printing is executed (i.e., all the four colors of K, Y, M and C colors are used for image formation), the controller 800 controls the switching mechanism 150 so that all the developing units 630 are located at the contact positions as shown in FIG. 10A. With this control, the toner can be supplied from all the developing units 630 to the respective photosensitive bodies 610. When the monochrome printing is executed (i.e., only the K color is used for image formation), the controller 800 controls the switching mechanism 150 so that only the developing unit 630K is located at the contact position, while the developing units 630Y, 630M and 630C are located at the spaced positions as shown in FIG. 10B. With this control, it is less likely that the toner is adhered on the photosensitive bodies 610Y, 610M and 610C inadvertently. Further, when the printer 10*c* is in a third mode in which none of the color printing and monochrome printing is executed, the controller 800 controls the switching mechanism 150 so that all the developing units 630 are located at the spaced positions as shown in FIG. 10C.

Figure 11:
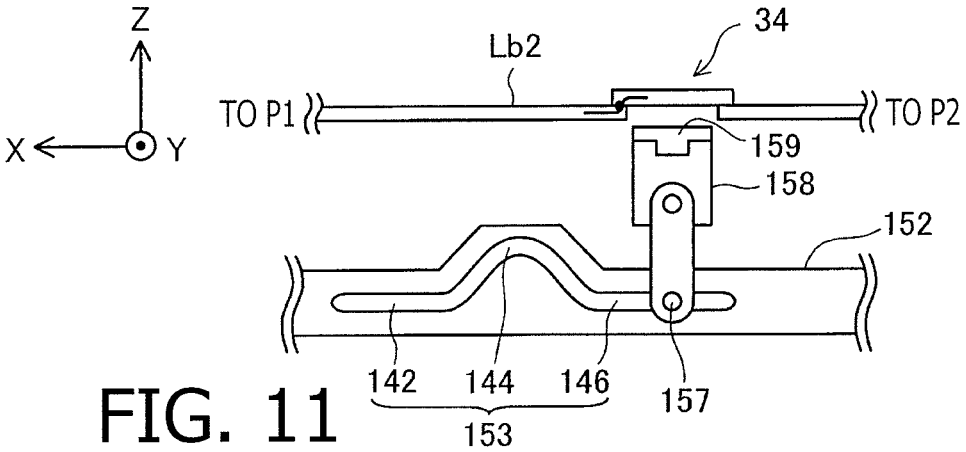
FIGS. 11-13 show a relationship between a linear moving cam and a switching element according to the embodiment of the disclosures.
Figure 12:
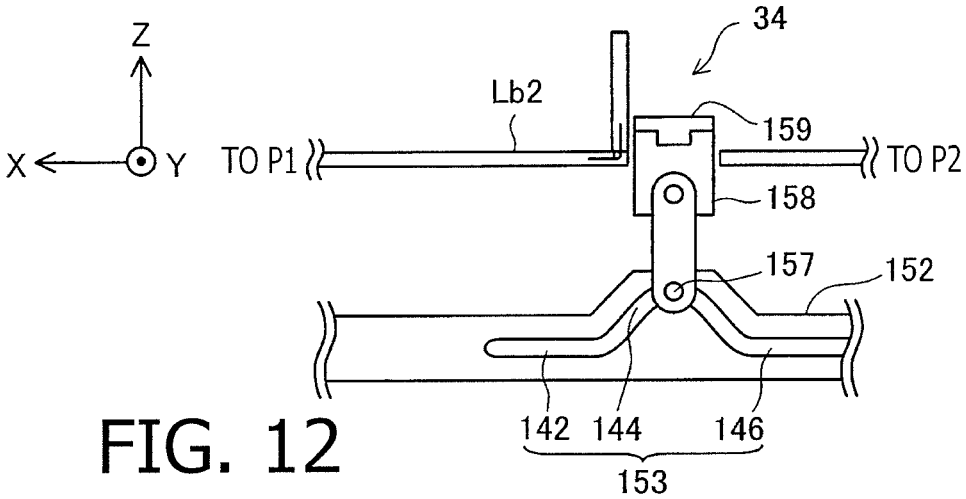
Figure 13:
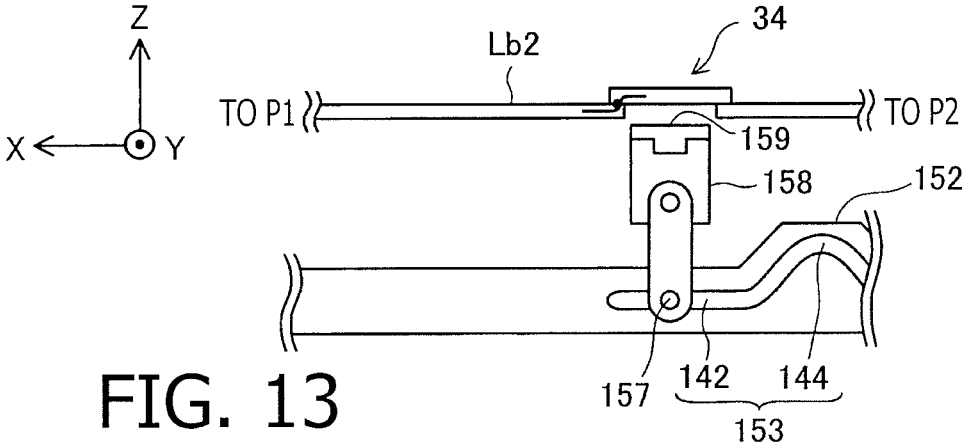

It is noted that, the modified embodiment shown in FIGS. 9 and 10A-10C is configured such that the controller 800 controls the switching mechanism 150 to switch the states of the switching element 34 into the connecting state or the disconnecting states. As shown in FIGS. 11-13, the translation cam 152 of the switching mechanism 150 is formed with a groove 153. The groove 153 includes two parallel parts 142 and 146 which extends in parallel with a moving direction of the translation cam 152 (i.e., in the X axis direction), and a curved part 144, which is arranged between the two parallel parts 142 and 146 and curves upward to approach the switching element 34. On the translation cam 152 side with respect to the switching element 34, an interfering member 158 is arranged. The interfering member 158 has a connection part 157, which engages with the groove 153 of the translation cam 152 (see FIGS. 11-13).

When the translation cam 152 is located at a position shown in FIG. 11, the connection part 157 of the interfering member 158 is located in the parallel part 146. In this state, an end part 159 on the switching element 34 side of the interfering member 158 does not interfere with the switching element 34. Therefore, the switching element 34 is in the connecting state. As the translation cam 152 moves rightward in FIG. 11 (i.e., a negative direction along the X axis) and located at a position shown in FIG. 12, the connecting part 157 of the interfering member 158 is located in the curved part 144. In this state, the interfering member 158 moves toward the switching element 34, and the end part 159 of the interfering member 159 interferes with the switching element 34, thereby the switching element 34 being in the disconnecting state (FIG. 12). As the translation cam 152 is further moved rightward in FIG. 11 (i.e., in the negative direction along the X axis) and located at a position shown in FIG. 13, the connecting part 157 is located in the parallel part 142. In this state, the end part 159 of the interfering member 158 does not interfere with the switching element 34, and the switching element 34 is in the connecting state.

As described above, according to the modified embodiment shown in FIGS. 9-13, the connecting/disconnecting states of the switching element 34 can be switched with use of the switching mechanism which switches the positions of the developing units 630. According to this configuration, the number of parts can be reduced and downsizing of the apparatus can be achieved. Further, it is ensured that switching of positions of the developing units 630 and switching of the connecting/disconnecting states of the switching element 34 can be carried out in an associated manner.

The technique disclosed in this specification should not be limited to the configurations described above. Rather, the configurations could be modified in various ways without departing from the gist of the disclosures. Some examples of such variations will be described below.

The configuration of the printer 10 according to the above-described embodiment is only an example, and could be modified in various ways. For example, the printer 10 according to the embodiment is configured to form an image using toner of K, Y, M and C colors. However, the number and/or colors to be used may not be limited to the configuration above.

Further, the image forming apparatus may not be limited to a stand-alone printer, but could be apparatuses such as a copier, a facsimile machine and a multi-function peripheral which includes a printer function.

The image forming apparatus may not be limited to a configuration of forming an image using toner having a positive polarity, but could be a configuration using toner having a negative polarity. In the latter case, the polarity of each voltage is opposite to what is described in the above-embodiments.

In the above-described embodiment, the chargers 620 are of the scorotron type having the grid electrodes 625 as examples. It is noted that the type of the chargers may not be limited to the scorotron type, but could be of corotron type which does not include a grid electrode. Alternately, the chargers could be of a roller type or a brush type, which is configured to charge the photosensitive bodies 610 by contacting the photosensitive bodies and applying voltages thereto.

In the above-described embodiment, the grid voltage GRID is adjusted with the grid voltage applying circuit 71. However, such a circuit for adjusting the grid voltage GRID could be omitted. Further, circuits for detecting the grid currents Ig could also be omitted.

In the above-described embodiment, the processes executed by the controller 800 may be modified to be executed by one or more CPU's and/or one or more ASIC's 805. In such a case, the execution subject of such processes is an example of a controller. It is noted that the controller 800 is a collective name including hardware used to control the printer 10 (e.g., the CPU 801) and does not necessarily mean a single piece of hardware of the printer 10.

In the charge controlling process shown in FIG. 6, some of the process (steps) may be modified, omitted and/or exchanged. For example, in the charge controlling process described above, the controller executes the error notifying process (S270) when it is determined that the least grid current Ig among the grid currents Ig1-Ig4 is equal to or less than the second threshold value (S260: YES). However, in such a case, instead of executing the error notifying process, the least grid current Ig may be raised to be greater than the second threshold value by increasing the duty ratio of the PWM signal Sp1 supplied to the voltage outputting circuit 60 to increase the output voltage CHG. According to such a control, even when the second charging control is executed, the grid currents Ig in the chargers 620Y, 620M and 620C may be greater than the second threshold value. Thus, according to such a control, the absolute value of the charged potential of one of the photosensitive bodies 610Y, 610M and 610C may not be excessively small, thereby the toner may not adhere to the photosensitive body 610 and the image quality may not get poor.

When the printer 10 has the voltage dropping circuit 20 as shown in FIG. 7 or FIG. 8, modifications as follows may be made. In the charge controlling process described above, the controller executes the error notifying process (S270) when it is determined that the least grid current Ig among the grid currents Ig1-Ig4 is equal to or less than the second threshold value (S260: YES). However, in such a case, instead of executing the error notifying process, the duty ratio of the PWM signal Sp2 or the PWM signal Sp3 supplied to the voltage adjusting circuit 42 or the light emission adjusting circuit 46 to increase the dropped output voltage dCHG to be applied to the wire electrodes 623Y, 623M and 623C, thereby the least grid current Ig is raised to be greater than the second threshold value. According to such a control, even when the second charging control is executed, the grid currents Ig in the chargers 620Y, 620M and 620C may be greater than the second threshold value. Thus, according to such a control, the absolute value of the charged potential of one of the photosensitive bodies 610Y, 610M and 610C may not be excessively small, thereby the toner may not adhere to the photosensitive body 610 and the image quality may not get poor.

In the charge controlling process according to the embodiment, control of the voltage outputting circuit 60 is executed based on the gird current Ig. As a modification, control of the voltage outputting circuit 60 is executed based on another index value such as the grid voltage GRID instead of the grid current Ig.

Further, in the above-described embodiment, a message encouraging the user to clean the wire electrode 623 of the charger 620 with the wire cleaner 627 is displayed on the display 820 in the error notifying process S270. In a modification, instead of, or in addition to displaying a message, another notifying methods such as sound and/or illumination may be used to notify information regarding contamination of the wire electrodes 623.

What is claimed is:

1. An image forming apparatus, comprising:

a first photosensitive body;

a second photosensitive body;

a first charger that charges the first photosensitive body;

a second charger that charges the second photosensitive body;

a voltage outputting circuit;

a voltage dropping circuit; and a controller, wherein the controller selectively executes:

a first charging control to apply a first voltage to the first charger and the second charger, wherein the first charger and the second charger are connected in parallel, and wherein the first voltage is an output of the voltage outputting circuit; and a second charging control to apply the first voltage to the first charger and a second voltage to the second charger, wherein the second voltage is less than the first voltage and is an output of the voltage dropping circuit while the first voltage is an output of the voltage outputting circuit, and an input to the voltage dropping circuit, and wherein the second voltage, which is less than the first voltage, causes the second charger to generate corona discharge so that a surface of the second photosensitive body is charged.

2. The image forming apparatus according to claim 1, further comprising:

a voltage output line connected to an output terminal of the voltage outputting circuit;

a first branch line that connects a first point on the voltage output line with the first charger;

a second branch line that connects the first point on the voltage output line with a second point; and a third branch line that connects the second point with the second charger, wherein the voltage dropping circuit is connected to the second branch line.

3. The image forming apparatus, according to claim 1, wherein the voltage dropping circuit comprises:
a resistor; and
a switching element connected to the resistor in parallel,
wherein the controller:
places the switching element in a connecting state in the first charging control; and
places the switching element in a disconnecting state in the second charging control.

4. The image forming apparatus according to claim 1, wherein the voltage dropping circuit includes a voltage adjusting circuit which adjusts a voltage applied to the second charger based on a voltage control signal supplied from the controller, and
wherein the controller:
supplies a first voltage control signal corresponding to the first voltage to the voltage adjusting circuit in the first charging control; and
supplies a second voltage control signal corresponding to the second voltage to the voltage adjusting circuit in the second charging control.

5. The image forming apparatus according to claim 1, wherein each of the first charger and the second charger includes:
a discharging electrode to which a voltage is to be applied; and
a grid electrode facing the discharging electrode,
wherein the image forming apparatus further comprises a current detecting circuit that detects grid currents flowing through the grid electrodes of the first and second chargers, and
wherein the controller varies an output voltage of the voltage outputting circuit based on the grid currents in each of the first charging control and the second charging control.

6. The image forming apparatus according to claim 5, wherein the controller:
changes the output voltage of the voltage outputting circuit based on a least grid current among the grid currents in each of the first charger and the second charger in the first charging control; and
changes the output voltage of the voltage outputting circuit based on the gird current in the first charger in the second charging control.

7. The image forming apparatus according to claim 5, wherein, when the grid currents of the second charger is less than a particular value, the controller controls at least one of the voltage outputting circuit and the voltage dropping circuit to control the grid current to be greater than the particular value in the second charging control.

8. The image forming apparatus according to claim 5, further comprising a notifying device,
wherein the controller causes the notifying device to notify information regarding contamination of the discharging electrode when the grid current of the second charger is less than a particular value in the second charging control.

9. The image forming apparatus according to claim 1, further comprising:
a first developing device that supplies developing agent to the first photosensitive body;
a second developing device that supplies the developing agent to the second sensitive body; and
a switching mechanism that moves each of the developing devices between a contact position at which the each of the developing devices contacts a corresponding one of the photosensitive bodies and a spaced position at which each of the developing devices is spaced from the corresponding one of the photosensitive bodies,
wherein the controller:
controls the switching mechanism to move the first developing device and the second developing device to the contact positions in the first charging control; and
controls the switching mechanism to move the first developing device to the contact position, while move the second developing device to the spaced positions in the second charging control.

10. The image forming apparatus according to claim 9, wherein the voltage dropping circuit includes:
a resistor; and
a switching element connected to the resistor in parallel, and
wherein the controller:
controls the switching element to be in a connecting state in the first charging control; and
controls the switching element to be in a disconnecting state in the second charging control.

11. A controlling method of an image forming apparatus having a first photosensitive body, a second photosensitive body, a first charger that charges the first photosensitive body, a second charger that charges the second photosensitive body, a voltage outputting circuit and a voltage dropping circuit,
wherein the controlling method comprises:
a first charging step to apply a first voltage to the first charger and the second charger, wherein the first charger and the second charger are connected in parallel, and wherein the first voltage is an output of the voltage outputting circuit; and
a second charging step to apply the first voltage to the first charger and a second voltage to the second charger, wherein the second voltage is less than the first voltage and is an output of the voltage dropping circuit while the first voltage is an output of the voltage outputting circuit, and an input to the voltage dropping circuit, and wherein the second voltage, which is less than the first voltage, causes the second charger to generate corona discharge so that a surface of the second photosensitive body is charged.

12. A non-transitory computer-readable medium for an image forming apparatus having a first photosensitive body, a second photosensitive body, a first charger that charges the first photosensitive body, a second charger that charges the second photosensitive body, a voltage outputting circuit, a voltage dropping circuit, and a controller,
wherein the computer-readable medium stores instructions which, when executed by the controller, cause the image forming apparatus to execute:
a first charging step to apply a first voltage to the first charger and the second charger, wherein the first charger and the second charger are connected in parallel, and wherein the first voltage is an output of the voltage outputting circuit; and
a second charging step to apply the first voltage to the first charger and a second voltage to the second charger, wherein the second voltage is less than the first voltage and is an output of the voltage dropping circuit while the first voltage is an output of the voltage outputting circuit, and an input to the voltage dropping circuit, and wherein the second voltage, which is less than the first voltage, causes the second charger to generate corona discharge so that a surface of the second photosensitive body is charged.

* * * * *